US007368042B2

(12) United States Patent
Hsu et al.

(10) Patent No.: US 7,368,042 B2
(45) Date of Patent: May 6, 2008

(54) ELECTROPLATING APPARATUS INCLUDING A REAL-TIME FEEDBACK SYSTEM

(75) Inventors: Chia-Lin Hsu, Tai-Nan (TW); Kun-Hsien Lin, Tainan County (TW); Wen-Chieh Su, Tai-Nan County (TW)

(73) Assignee: United Microelectronics Corp., Hsin-Chu (TW)

( * ) Notice: Subject to any disclaimer, the term of this patent is extended or adjusted under 35 U.S.C. 154(b) by 583 days.

(21) Appl. No.: 10/905,361

(22) Filed: Dec. 30, 2004

(65) Prior Publication Data

US 2006/0144698 A1 Jul. 6, 2006

(51) Int. Cl.
*B23H 3/02* (2006.01)

(52) U.S. Cl. ..... 204/228.1; 204/228.7; 204/229.5

(58) Field of Classification Search ..... 205/81, 205/82, 83, 84; 204/228.1, 228.7, 229.5
See application file for complete search history.

(56) References Cited

U.S. PATENT DOCUMENTS

| | | | | |
|---|---|---|---|---|
| 6,391,166 | B1 * | 5/2002 | Wang | 204/224 R |
| 6,761,812 | B2 * | 7/2004 | Preusse et al. | 205/81 |
| 7,153,400 | B2 * | 12/2006 | Ravkin et al. | 204/224 R |
| 2007/0068819 | A1 | 3/2007 | Singh | |

FOREIGN PATENT DOCUMENTS

| | | |
|---|---|---|
| TW | 592858 | 6/2004 |

* cited by examiner

*Primary Examiner*—Nam Nguyen
*Assistant Examiner*—Luan V. Van
(74) *Attorney, Agent, or Firm*—Winston Hsu

(57) ABSTRACT

An electro-chemical plating system includes an upper rotor assembly for receiving and holding a wafer; an electroplating reactor vessel for containing plating solution in which the wafer is immersed; an anode array including a plurality of concentric anode segments provided inside the electroplating reactor vessel; a power supply system including power supply subunits for controlling electrical potentials of the anode segments, respectively; and a plurality of sensor devices mounted inside the upper rotor assembly, wherein the sensor devices are substantially arranged in corresponding to the anode segments, and during operation, the plurality of sensor devices are utilized for in-situ feeding back a deposition profile to a control unit in real time.

5 Claims, 1 Drawing Sheet

ELECTROPLATING APPARATUS INCLUDING A REAL-TIME FEEDBACK SYSTEM

BACKGROUND OF THE INVENTION

1. Field of the Invention

The present invention relates to the field of electro-chemical plating and, more particularly, to an electroplating apparatus including an in-line, real-time feedback system for uniformly electroplating metals on a semiconductor substrate.

2. Description of the Prior Art

In the fabrication of a semiconductor integrated circuit, metals are electro-chemically deposited onto a semiconductor substrate in order to electrically interconnect components in the integrated circuit. Typically, the substrate with a seed layer is positioned in an electroplating reactor vessel containing plating solution. At the bottom of the electroplating reactor vessel, an anode is provided for creating a desired electrical potential at the surface of the substrate.

For years, many attentions have been directed to the variations in current density across the surface of the substrate immersed in the plating solution during electroplating. Efforts to improve uniformity of electroplated metal layers include flow-controlling devices such as diffusers positioned within the electroplating reactor vessel for directing the flow of the electroplating solution. In some cases, uniformity of metal deposition is improved by using a segmented anode array including a plurality of concentric anode segments, which are operated independently at different electrical potentials.

However, the aforesaid prior art methods and/or apparatuses are still not satisfactory yet due to the fact that the metal depositing conditions are not controlled in real time.

SUMMARY OF THE INVENTION

It is therefore a primary object of the present invention to provide an electroplating apparatus including a real-time feedback system for uniformly electroplating metals on a semiconductor substrate.

In accordance with the preferred embodiment, an electro-chemical plating system is provided. The electro-chemical plating system includes an upper rotor assembly for receiving and holding a wafer; an electroplating reactor vessel for containing plating solution in which the wafer is immersed; an anode array including a plurality of concentric anode segments provided inside the electroplating reactor vessel; a power supply system including power supply subunits for controlling electrical potentials of the anode segments, respectively; and a plurality of sensor devices mounted inside the upper rotor assembly, wherein the sensor devices are substantially arranged in corresponding to the anode segments, and during operation, the plurality of sensor devices are utilized for in-situ feeding back a deposition profile to a control unit in real time.

These and other objectives of the present invention will no doubt become obvious to those of ordinary skill in the art after reading the following detailed description of the preferred embodiment that is illustrated in the various FIGURES and drawings.

DETAILED DESCRIPTION

Figure 1:
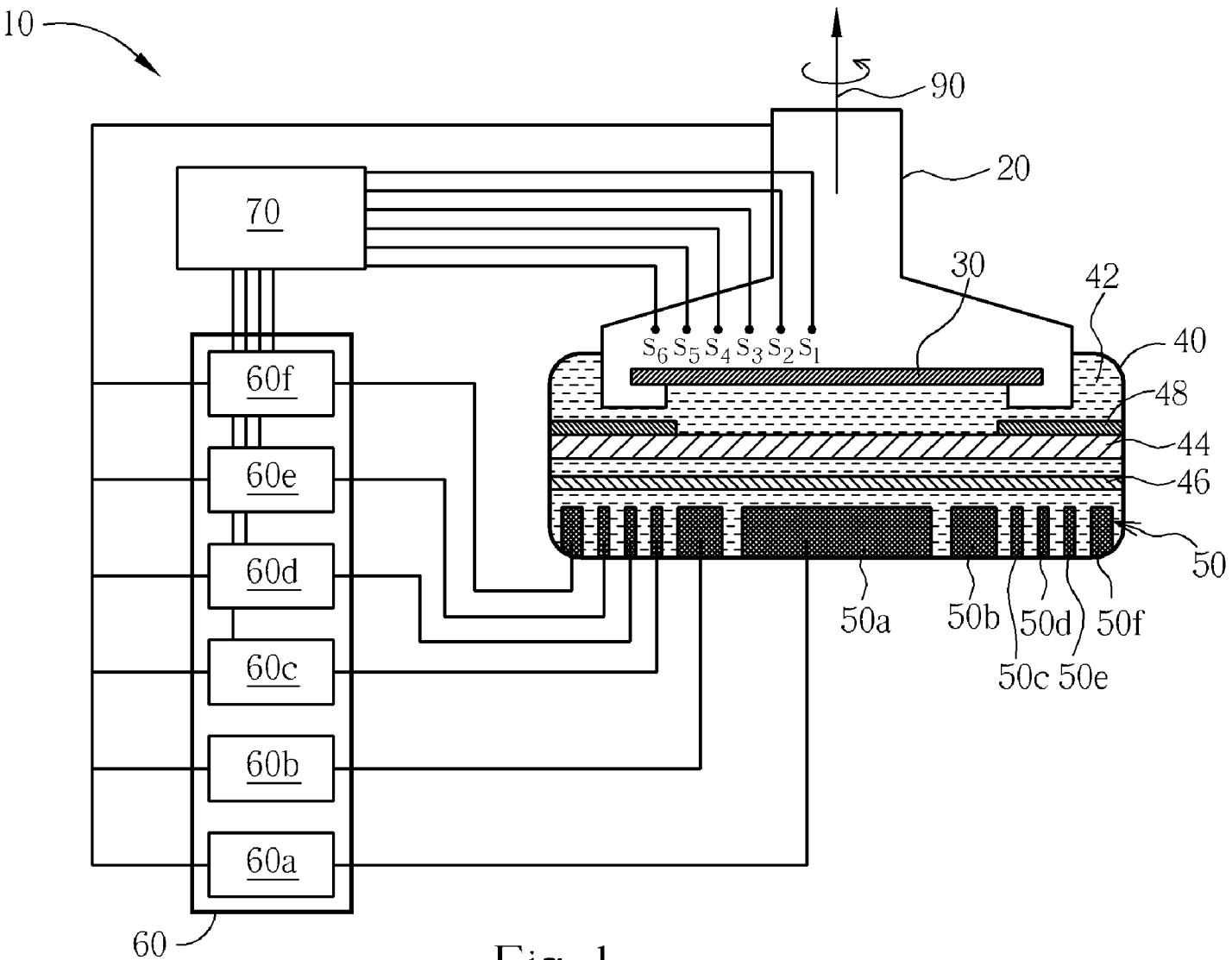
FIG. 1 is a schematic diagram illustrating an electroplating apparatus with a real-time, closed-loop feedback system in accordance with one preferred embodiment of the present invention.

Please refer to FIG. 1. FIG. 1 is a schematic diagram illustrating an electroplating apparatus 10 in accordance with one preferred embodiment of the present invention. As shown in FIG. 1, the electroplating apparatus 10 includes an upper rotor assembly 20 for receiving and holding a wafer 30. The upper rotor assembly 20 may comprise a drive rotor (not shown) for rotatably driving the wafer 30 about the axis 90 substantially normal to the wafer surface. The electroplating apparatus 10 further includes an electroplating reactor vessel 40 for containing plating solution 42. During operation, the wafer 30 is immersed in the plating solution 42 for electroplating. It is to be understood that supply and re-circulation systems for the plating solution may be provided, but are not specifically shown in this FIGURE.

At the bottom of the electroplating reactor vessel 40, an anode array 50 including a plurality of concentric anode segments 50*a*~50*f* is provided. Optionally, a diffuser 44, a membrane 46, and/or a shielding ring 48 may be installed in between the wafer 30 and the anode array 50 inside the electroplating reactor vessel 40.

The wafer 30 is electrically connected to a power supply system 60 such that the wafer 30 servers as a cathode electrode during electroplating. The power supply system 60 further includes a plurality of power supply subunits 60*a*~60*f*, which control the electrical potentials of the anode segments 50*a*~50*f*, respectively.

A plurality of sensor devices $S_1$~$S_6$ are mounted inside the upper rotor assembly 20. The sensor devices $S_1$~$S_6$ are substantially arranged at the backside of the wafer 30 in corresponding to the concentric anode segments 50*a*~50*f*, and rotate as the wafer rotates. Suitable sensor devices $S_1$~$S_6$ include commercially available eddy current sensors or the like. During operation, the plurality of sensor devices $S_1$~$S_6$ are utilized for in-situ feeding back a deposition profile to a control unit 70, for example, a computer, in real time. According to the real-time deposition profile detected by the sensor devices, the control unit 70 alters the output of individual power supply subunits 60*a*~60*f*, thereby improving the uniformity of electroplated metal layers.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electro-chemical plating system comprising:

an upper rotor assembly for receiving and holding a wafer;

an electroplating reactor vessel for containing plating solution in which the wafer is immersed;

an anode array including a plurality of anode segments provided inside the electroplating reactor vessel;

a power supply system including power supply subunits for controlling electrical potentials of the anode segments, respectively; and a plurality of sensor devices mounted inside the upper rotor assembly, wherein the sensor devices are substantially arranged in corresponding to the anode segments, and during operation, the plurality of sensor devices are utilized for in-situ feeding back a deposition profile to a control unit in real time.

2. The electroplating apparatus according to claim 1 wherein the sensor devices are eddy current sensors.

3. The electroplating apparatus according to claim 1 wherein the control unit receives the real-time deposition profile detected by the sensor devices, and alters power output of individual power supply subunits of the power supply system.

4. The electroplating apparatus according to claim 1 wherein the wafer is electrically connected to the power supply system such that the wafer serves as a cathode electrode during electroplating.

5. The electroplating apparatus according to claim 1 wherein the plurality of anode segments are concentrically arranged inside the electroplating reactor vessel.

* * * * *